US007987862B2

(12) United States Patent
McCormick et al.

(10) Patent No.: US 7,987,862 B2
(45) Date of Patent: Aug. 2, 2011

(54) WASH FLUID CONTAINMENT SYSTEM FOR USE ON AN UNEVEN SURFACE

(75) Inventors: James P. McCormick, Sandy, UT (US); Richard Lopez, West Jordan, UT (US)

(73) Assignee: Hydro Engineering Equipment & Supply Company, Salt Lake City, UT (US)

( * ) Notice: Subject to any disclaimer, the term of this patent is extended or adjusted under 35 U.S.C. 154(b) by 269 days.

(21) Appl. No.: 12/110,165

(22) Filed: Apr. 25, 2008

(65) Prior Publication Data

US 2009/0266384 A1 Oct. 29, 2009

(51) Int. Cl.
*B08B 3/00* (2006.01)
*B08B 3/04* (2006.01)

(52) U.S. Cl. ..... 134/123; 134/104.2

(58) Field of Classification Search ..... 134/123, 134/104.2
See application file for complete search history.

(56) References Cited

U.S. PATENT DOCUMENTS

| | | | | |
|---|---|---|---|---|
| 830,437 | A * | 9/1906 | Humphrey | 405/113 |
| 3,772,723 | A | 11/1973 | Krimm | |
| 3,971,394 | A | 7/1976 | Osborne | |
| 4,071,223 | A * | 1/1978 | Demarest | 256/1 |
| 4,246,982 | A | 1/1981 | Pretnick | |
| 4,308,136 | A | 12/1981 | Warne, Jr. | |
| 4,498,660 | A * | 2/1985 | Brema et al. | 256/19 |
| 4,808,237 | A | 2/1989 | McCormick et al. | |
| 5,033,489 | A | 7/1991 | Ferre et al. | |
| 5,145,309 | A | 9/1992 | Foster | |
| 5,190,268 | A * | 3/1993 | Espinueva | 256/67 |
| 5,330,579 | A | 7/1994 | Rushing et al. | |
| 5,498,329 | A | 3/1996 | Lamminen et al. | |
| 5,535,766 | A | 7/1996 | Edwards | |
| 5,547,312 | A | 8/1996 | Schmitz, Jr. | |
| 5,597,001 | A | 1/1997 | Rasmussen et al. | |
| 5,669,982 | A | 9/1997 | Latimer | |
| 5,673,715 | A * | 10/1997 | Carter | 134/104.4 |
| 5,732,646 | A * | 3/1998 | Brandt | 114/122 |
| 5,738,139 | A | 4/1998 | DeChard | |
| 5,785,067 | A | 7/1998 | Kosofsky | |
| 5,803,982 | A | 9/1998 | Kosofsky et al. | |
| 5,901,526 | A * | 5/1999 | Vidmar et al. | 52/745.09 |
| 6,000,631 | A | 12/1999 | Lamminen et al. | |
| 6,021,792 | A * | 2/2000 | Petter et al. | 134/111 |
| 6,106,712 | A | 8/2000 | New | |
| 6,247,480 | B1 * | 6/2001 | Wegner | 134/111 |
| 6,293,523 | B1 * | 9/2001 | Fendler | 256/27 |
| 6,301,848 | B1 * | 10/2001 | Whitaker | 52/302.1 |

(Continued)

FOREIGN PATENT DOCUMENTS

GB 2256443 A * 12/1992

(Continued)

*Primary Examiner* — Michael Barr
*Assistant Examiner* — Charles W Kling
(74) *Attorney, Agent, or Firm* — Holland & Hart

(57) ABSTRACT

A wash fluid containment system may include side walls that allow the systems to be easily positioned on uneven ground. The side walls are designed to reduce or eliminate binding and/or gaps that occur when conventional systems are placed on uneven ground. In one embodiment, the side walls include different portions that are adjustable relative to each other to allow the side walls to accommodate the uneven ground. The side walls may include one or more horizontally oriented panels that are adjustable relative to one or more vertically oriented support members.

27 Claims, 12 Drawing Sheets

U.S. PATENT DOCUMENTS

| | | | | |
|---|---|---|---|---|
| 6,402,855 | B1 * | 6/2002 | Damron et al. | 134/10 |
| 6,561,201 | B1 | 5/2003 | Midkiff | |
| 6,601,831 | B2 * | 8/2003 | Erwin | 256/65.05 |
| 6,655,396 | B2 | 12/2003 | Krenzel | |
| 6,799,591 | B2 | 10/2004 | McCormick et al. | |
| 7,258,749 | B2 | 8/2007 | McCormick et al. | |
| 7,303,358 | B1 * | 12/2007 | Fuller | 405/114 |
| 2002/0117191 | A1 | 8/2002 | Krenzel | |
| 2003/0205257 | A1 | 11/2003 | Gross | |
| 2004/0200503 | A1 | 10/2004 | McCormick et al. | |
| 2004/0231703 | A1 * | 11/2004 | McCormick et al. | 134/10 |
| 2006/0169965 | A1 * | 8/2006 | Paskar | 256/60 |
| 2007/0256712 | A1 | 11/2007 | McCormick et al. | |
| 2009/0250176 | A1 * | 10/2009 | Ryan et al. | 160/185 |

FOREIGN PATENT DOCUMENTS

| | | | |
|---|---|---|---|
| GB | 2261000 | A * | 5/1993 |

* cited by examiner

WASH FLUID CONTAINMENT SYSTEM FOR USE ON AN UNEVEN SURFACE

BACKGROUND

A wash fluid containment system may be used to wash objects such as equipment, materials, vehicles, and so forth. The wash fluid containment system is used to prevent the wash fluid and any associated impurities from escaping and contaminating the surrounding environment or creating a messy work area. The wash fluid and any impurities are captured by the wash fluid containment system and treated or disposed of appropriately.

Wash fluid containment systems are being used more and more frequently to clean a variety of objects such as heavy industrial, mining, and/or agricultural vehicles, as well as other associated equipment. Items such as these tend to get dirty quickly and, when they are washed, tend to generate a significant quantity of contaminated wash fluid. The wash fluid may contain contaminants ranging from soap, detergent, and wax, which may be added to the fluid prior to washing; gasoline, oil, and grease that may be washed from the vehicle or other piece of equipment; to various other contaminants and solids that build up on the vehicle or other equipment during use.

Wash fluid containment systems are often deployed on an uneven surface such as bare ground that has not been properly leveled or concrete and/or asphalt pads that are in disrepair. This causes the base of the wash fluid containment system to flex, bend, and/or pivot to match the shape of the underlying surface. This is especially a problem when the base is made of one or more support modules coupled together. If the base is uneven, it makes it difficult to properly assemble the side walls. The uneven base causes the side walls to bind against each other (e.g., when the base has a concave shape) or creates gaps between the side walls (e.g., when the base has a convex shape) that allow wash fluid to escape and are unsightly.

It would be desirable to provide an improved wash fluid containment system that can be placed on uneven surfaces without causing problems with the side walls.

SUMMARY

A number of embodiments of improved wash fluid containment systems are described herein. In one embodiment, the wash fluid containment system includes improved side walls that allow the wash fluid containment system to be placed on an uneven ground surface. The side walls are configured to reduce or eliminate binding and/or gaps that occur when conventional systems are placed on uneven ground. The side walls may include different portions that are adjustable relative to each other to allow the side walls to accommodate the uneven base of the wash fluid containment system.

In one embodiment, a wash fluid containment system comprises a base and a side wall that extends upward from the base. The side wall may include a first vertical support member, a second vertical support member, a top, and a bottom. The top and the bottom of the side wall may be parallel to each other and at least one of the first vertical support member or the second vertical support member is not perpendicular to at least one of the top or the bottom of the side wall.

In another embodiment, a wash fluid containment system comprises a base and a side wall that extends upward from the base. The side wall may include a first portion and a second portion. The first portion of the side wall may be adjustable relative to the second portion of the side wall to accommodate for unevenness in the base.

In another embodiment, a wash fluid containment system comprises a base which is uneven and a side wall that extends upward from the base. The side wall and the base may be configured to prevent wash fluid from escaping from the wash fluid containment system. The side wall may be adjustable relative to the base to accommodate for the unevenness of the base.

In another embodiment, a wash fluid containment system comprises a base including a first base module coupled to a second base module and a side wall coupled to the base. The side wall may include a plurality of vertical support members and a plurality of panels that extend between the plurality of vertical support members. The plurality of panels may be adjustable relative to at least one vertical support member from the plurality of vertical support members to accommodate for unevenness between the first base module of the base and the second base module of the base.

The foregoing and other features, utilities, and advantages of the subject matter described herein will be apparent from the following more particular description of certain embodiments as illustrated in the accompanying drawings.

DRAWINGS

FIGS. 14 and 15 illustrate different embodiments of the side walls which are capable of accommodating the uneven surface.

DETAILED DESCRIPTION

A variety of embodiments of wash fluid containment systems are described herein. In general, a wash fluid containment system is a system that is used to wash an object and prevent the wash fluid and any associated contaminants from escaping into the environment or the surrounding work area. A wash fluid containment system may be used to wash any object that has become dirty or soiled. For example, the wash fluid containment system may be used to wash equipment such as heavy machinery, implements, vehicles, and so forth.

The various embodiments of the wash fluid containment system described herein may be similar in many respects to the wash fluid containment systems described in U.S. Pat. No. 7,258,749, entitled "Wash Fluid Containment System," issued on 21 Aug. 2007 and U.S. Patent Application Publication No. 2004/0231703, entitled "Low Profile Non-Clogging Non-Polluting Surface Treating Pads, Assemblies and Methods," published on 25 Nov. 2004, each of which is incorporated in its entirety by this reference. In the event of a conflict, the subject matter explicitly recited or shown herein controls over any subject matter incorporated by reference. All definitions of a term (express or implied) contained in any of the subject matter incorporated by reference herein are hereby disclaimed.

It should be appreciated that many of the elements and components of the wash fluid containment systems described herein may be similar or identical to the elements and components of the wash fluid containment systems described in the referenced patent documents. Accordingly, many of the components, elements, configurations, features, advantages, characteristics, etc, of the embodiments of the wash fluid containment systems described in the patent documents may be incorporated into the wash fluid containment systems described herein. Also, the nomenclature used in the referenced patent documents to describe a similar component or element may also be used to describe such a component or element herein.

Figure 1:
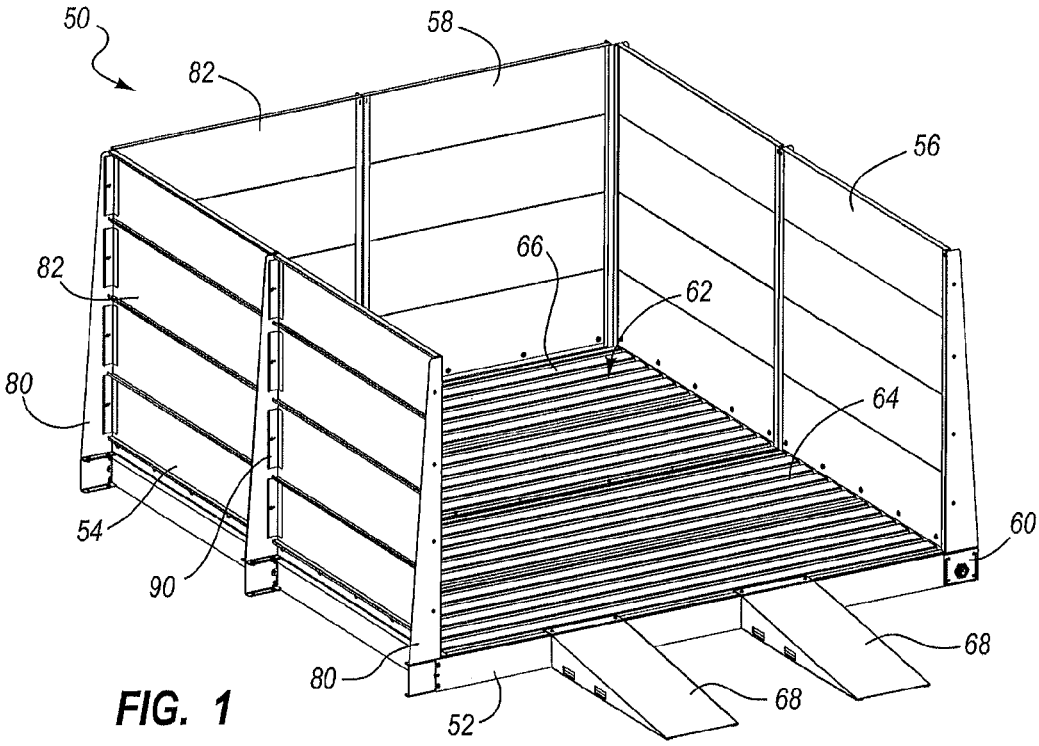
FIG. 1 is a front perspective view of one embodiment of a wash fluid containment system.
Figure 2:
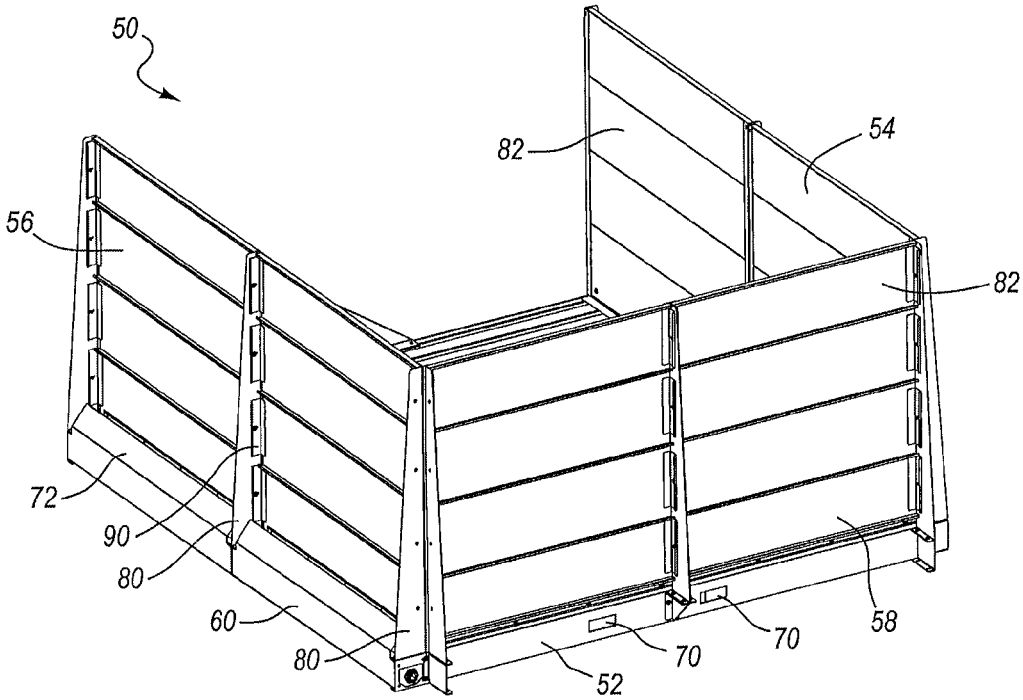
FIG. 2 is a rear perspective view of the wash fluid containment system of FIG. 1.

Turning to the FIGS., one embodiment of a wash fluid containment system 50 (also referred to herein as a wash station or wash pad) is shown in FIGS. 1 and 2. The wash fluid containment system 50 includes a base 52, and a plurality of side walls 54, 56, 58 that extend upward from the base 52. The base 52 is shaped to drain the wash fluid and associated contaminants and impurities away from the object being washed and into a collection trough or gutter 60. The side walls 54, 56, 58 prevent the wash fluid from splashing or spraying outside of the wash fluid containment system 50.

The base 52 includes a top surface 62 that is impervious to liquids and shaped to drain the wash fluid to the collection trough 60. The top surface 62 includes a plurality of channels or grooves 64 that extend across the top surface 62 to the collection trough 60. The channels 64 are sized and shaped to guide the spent wash fluid, along with any suitably small debris (large debris may be removed manually) and/or other contaminants, to the collection trough 60.

The top surface 62 and/or the channels 64 may be sloped towards the collection trough 60 to enhance the flow of the wash fluid. In one embodiment, the top surface 62 may be flat and the channels 64 may be sloped towards the collection trough 60. In another embodiment, both the top surface 62 and the channels 64 may be sloped towards the collection trough 60. It should be appreciated that it is also contemplated that both the top surface 62 and the channels 64 may be flat.

It should be appreciated that the top surface 62 may have any of a number of other suitable configurations. For example, in one embodiment, the top surface 62 may be porous. The top surface 62 may have a plurality of openings that allow the wash fluid to pass through to a collection surface positioned underneath. For example, part or all of the top surface 62 may be formed of expanded metal grating that allows the wash fluid, debris, and other contaminants to pass through to an underlying collection surface. The collection surface guides the wash fluid and contaminants to the collection trough 60. In this embodiment, the expanded metal grating acts as a screen to prevent large pieces of debris from inhibiting or clogging the flow of the wash fluid to the collection trough 60.

The base 52 may have a modular configuration that makes it easy to transport and assemble. The size of the base 52 may be enlarged or reduced by adding or removing modules. For example, as shown in FIG. 1, the base 52 includes two base modules 66 coupled together. The base 52 may be enlarged in length or width by adding additional base modules 66. The base 52 may be reduced in size by removing one of the base modules 66.

The individual base modules 66 may include holes or openings 70 (FIG. 2) sized and positioned to receive the forks from a forklift. The base modules 66 may also include hooks and/or other attachment devices to enable the base modules 66 to be picked up and moved with heavy equipment such as cranes, and the like. The holes 70 and the other attachment devices may also be used to move the wash fluid containment system 50 as a whole after it has been properly assembled.

Figure 16:
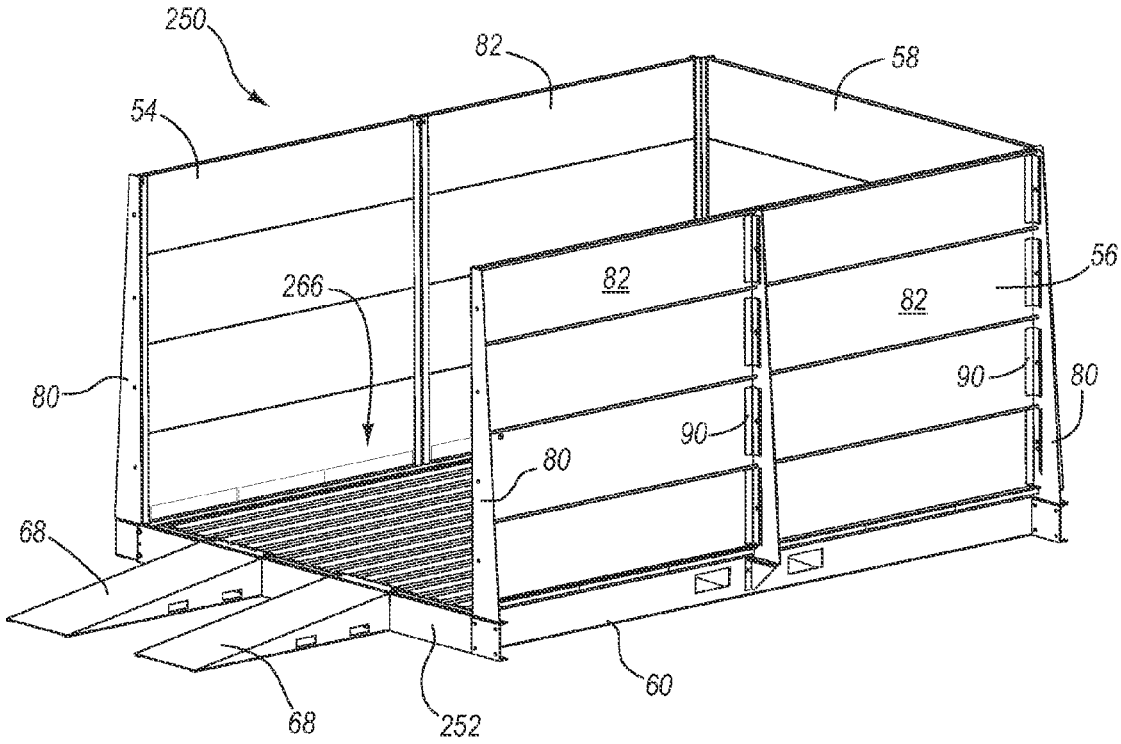
FIG. 16 is a front perspective view of another embodiment of a wash fluid containment system.

FIG. 16 illustrates one embodiment of a wash fluid containment system 250 having a base 252 that includes a single base module 266. The wash fluid containment system 250 is similar in many respects to the wash fluid containment system 50. However, some notable differences are that the base 252 of the wash fluid containment system 250 only includes a single module 66. Also, the collection trough 60 is positioned on a rear side of the wash fluid containment system 250.

The base modules 66 may be coupled together in a manner that prevents wash liquid from escaping at the joint. For example, a cover may be placed over the joint that drains the wash fluid to adjacent channels 64 in the top surface 62 of each base module 66. The cover may have a raised center portion that slopes to the edges. A gasket may also be placed in the joint to further seal each base module 66 together.

It should be noted that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The base 52 may be placed on any suitable piece of ground. When the base 52 is placed on uneven ground, the base modules 66 tend to flex and move relative to each other to best fit the contour of the ground. For example, one of the base modules 66 may pivot slightly upward or downward at the joint between the two base modules 66. The end result is that the base 52 is not a perfectly flat surface.

Small variations in the position of the base modules 66 can make it difficult to properly attach conventional side walls. Problems may arise even if one base module 66 is only one degree off relative to another base module 66. If one base module 66 is pivoted upward relative to another base module 66 then conventional side walls converge together so that there is insufficient room for both conventional side walls to extend upward. On the other hand, if one base module 66 is pivoted downward relative to another base module 66 then the conventional side walls diverge from each other and create a gap that allows wash fluid to escape from the system 50.

The base 52 is typically placed directly on the surface of the ground in an impermanent manner. For example, the base 52 may be held in place on the ground by its own weight. The base 52 may also be anchored to the ground with stakes, ropes, etc. Either way, the base 52 is considered to be impermanently positioned on the ground in comparison to asphalt, concrete, or the like that is paved over the ground. The latter materials when applied in a paving operation are considered to be permanently positioned on the ground.

The base 52 may be made of any suitable material such as metals, plastics, and/or composites. In heavy duty implementations, the base 52 may be made primarily of a heavy duty metal such as steel or the like. In lighter duty implementations, the base 52 may be made of plastic either alone or in combination with metals such as steel or composites.

In one embodiment, the base 52 may be configured to support vehicles such as heavy machinery used in construction, mining, and industry. Examples of vehicles that may be received by the base 52 include loaders, tractor-trailer rigs, dump trucks, and the like. In this embodiment, the base 52 may be made primarily of a relatively heavy gauge steel to impart the strength needed to repeatedly support heavy loads such as these.

The base 52 may be positioned on the ground so that the top surface 62 is raised above the ground. This is illustrated in FIG. 1. A set of ramps 68 may be provided to allow vehicles and other objects to move from the ground surface to the top surface 62 of the base 52. In other configurations, the base 52 may be placed in a recess in the ground so that the top surface 62 is flush or substantially flush with the ground surface.

The collection trough 60 is a liquid impermeable container that is capable of collecting and/or holding the wash fluid that drains from the top surface 62 of the base 52. The collection trough 60 has an outlet through which the liquid in the collection trough 60 can be evacuated. The solids that remain in the collection trough 60 may be periodically removed. A cover 72 (FIG. 2) is provided over the collection trough 60 to prevent outside debris from entering the collection trough 60. The cover 72 also protects users from inadvertently stepping or tripping into the collection trough 60.

The solids that enter the collection trough 60 may be separated from the liquids and properly disposed of In one embodiment, the solids may be separated in the collection trough 60 itself. In another embodiment, the liquid-solids mixture may be pumped out of the collection trough 60 and treated in a separate system. The liquid may be recovered and recycled back to be used as the wash fluid. In another embodiment, the waste mixture may flow out of the collection trough 60 into a tank that is at grade or below grade. The waste mixture may then be pumped out of the tank for treatment.

Figure 3:
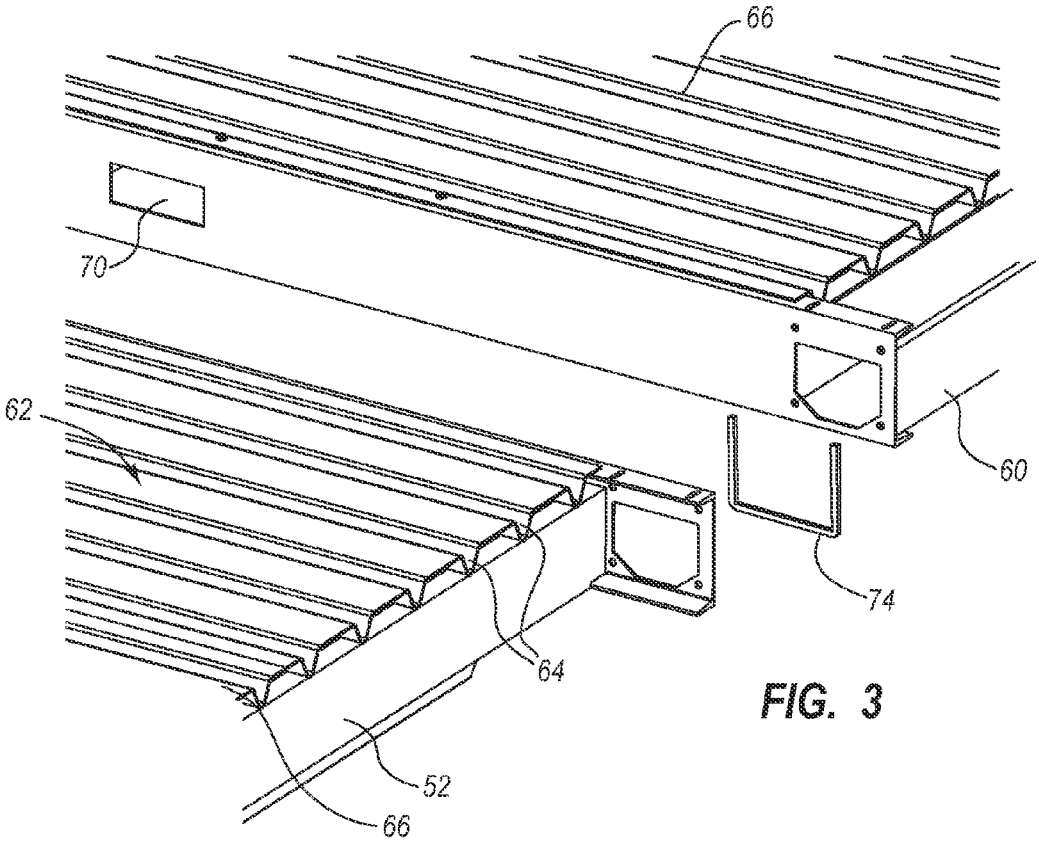
FIG. 3 is a partially exploded perspective of the wash fluid containment system of FIG. 1 that illustrates how two base modules are coupled together on the collection trough side of the wash fluid containment system.

Segments of the collection trough 60 from different base modules 66 may be coupled together to form one large collection trough 60 in the manner shown in FIG. 3. A gasket 74 is provided between the different segments to prevent any leaks at the joint. The gasket 74 may be similar (e.g., material used, size, and so forth) as the gasket referred to previously that optionally may be placed in the joint between each base module 66.

Turning back to FIGS. 1 and 2, the wash fluid containment system 50 includes a first side wall 54, a second side wall 56 positioned opposite the first side wall 54, and a rear or third side wall 58. The front of the wash fluid containment system 50 is left open to allow vehicles and other objects to easily enter and exit the system 50 using the ramps 68.

The wash fluid containment system 50 may have any number and/or configuration of side walls. For example, the wash fluid containment system 50 may include a side wall on all four sides of the base 52, or on one or two sides of the base 52. In one embodiment, the wash fluid containment system 50 may include two side walls on opposing sides of the base 52 to allow vehicles and/or other equipment to drive through the wash fluid containment system 50.

The side walls, when viewed from above, may be configured to form shapes other than a rectangle or a square. The side walls may form a hexagon, pentagon, triangle, or the like. The side walls may also form a curved or rounded shape such as a semi-circle or the like. Typically, the shape formed by the side walls is the same as the overall shape of the base 52. However, in some embodiments, the side walls may form a shape that is different than the shape of the base 52—e.g., the base 52 is rectangular and the side walls form a hexagon on top of the base 52.

The side walls 54, 56, 58 include a plurality of vertical support members 80 (also referred to herein as a first portion of the side wall) and a plurality of panels 82 that extend horizontally between the vertical support members 80 (also referred to herein as a second portion of the side wall). The vertical support members 80 in the side wall 56 are coupled to the top of the collection trough 60. For example, the vertical support members 80 may be coupled to the ends of each segment of the collection trough 60 depicted in FIG. 3.

Figure 4:
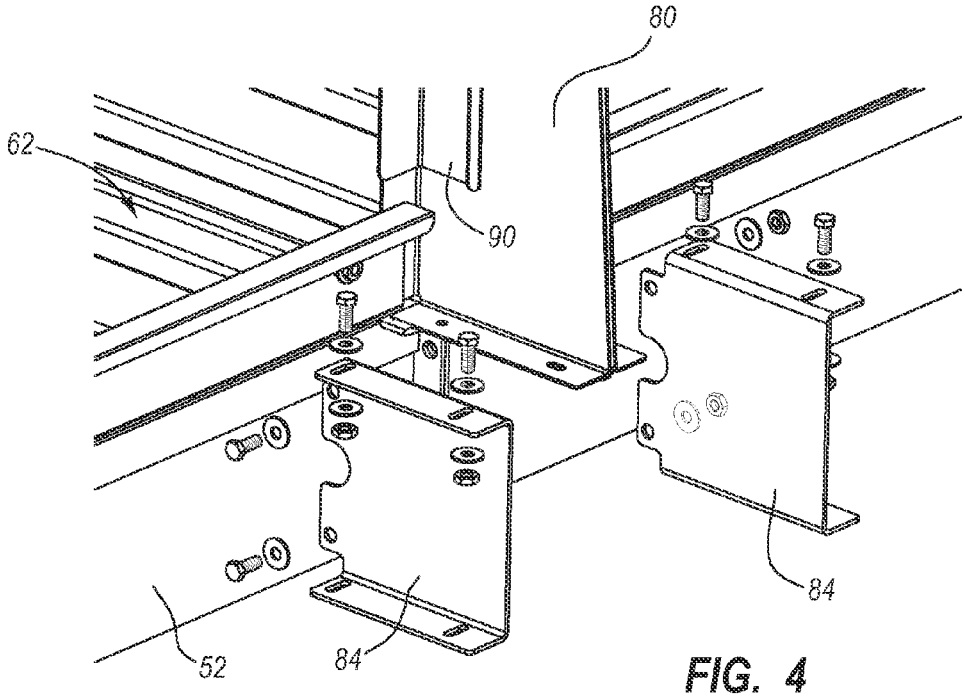
FIG. 4 is a partially exploded perspective view of the wash fluid containment system of FIG. 1 that illustrates how the vertical support members are coupled together in the middle of the side wall.
Figure 5:
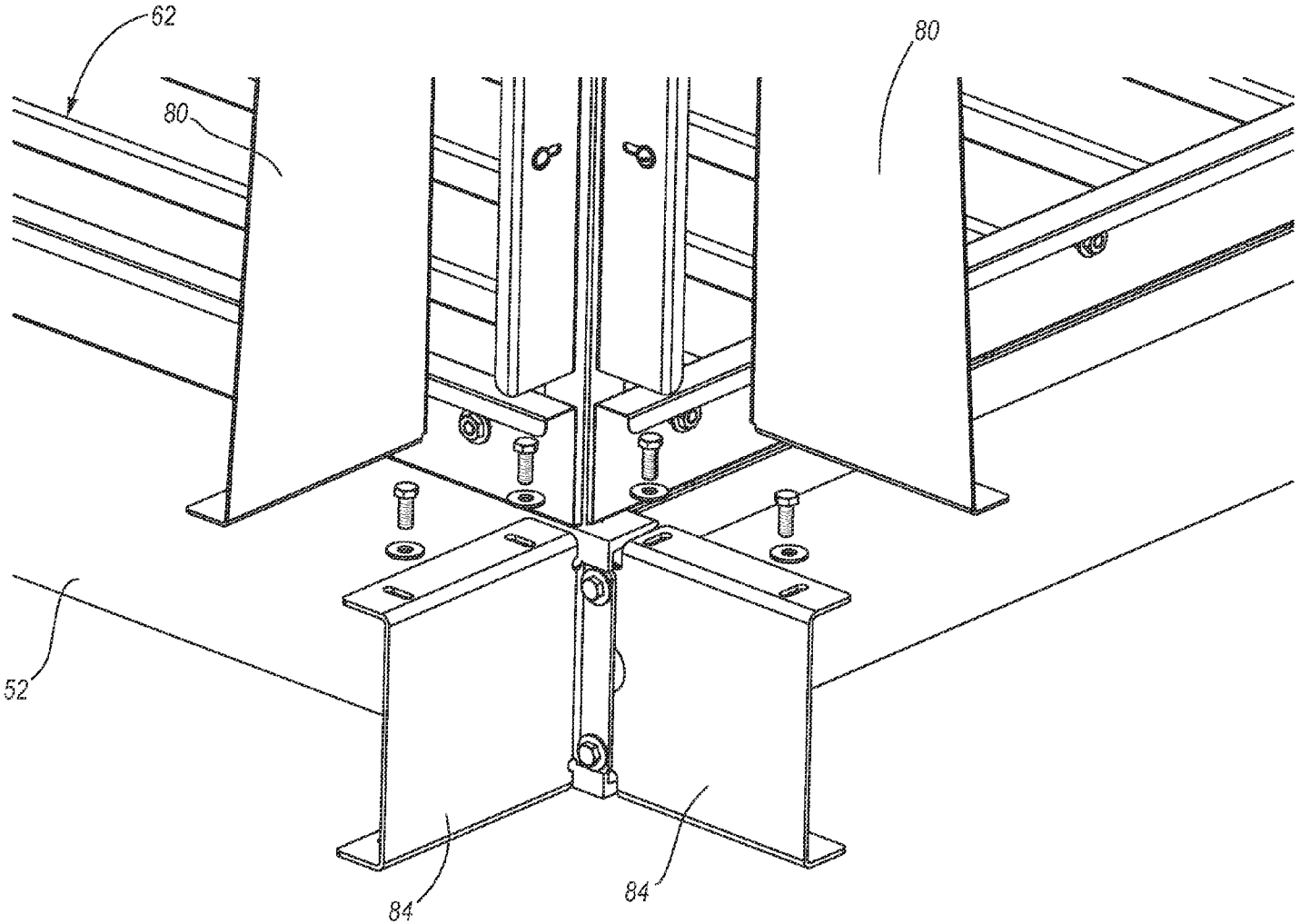
FIG. 5 is a partially exploded perspective view of the wash fluid containment system of FIG. 1 that illustrates how the vertical support members are coupled to the base at the corner of the side wall.

Each of the vertical support members 80 in the side walls 54, 58 includes a bracket 84 that is used to couple the vertical support member 80 to the base 52. Specifically, the bracket 84 is coupled to the base 52 and to the remainder of the vertical support member 80 that extends upward from the base 52. FIG. 4 illustrates how the vertical support members 80 are coupled to the base 52 in the middle of a side wall. FIG. 5 illustrates how the vertical support members 80 are coupled to the base 52 at the corner of the side wall.

Figure 6:
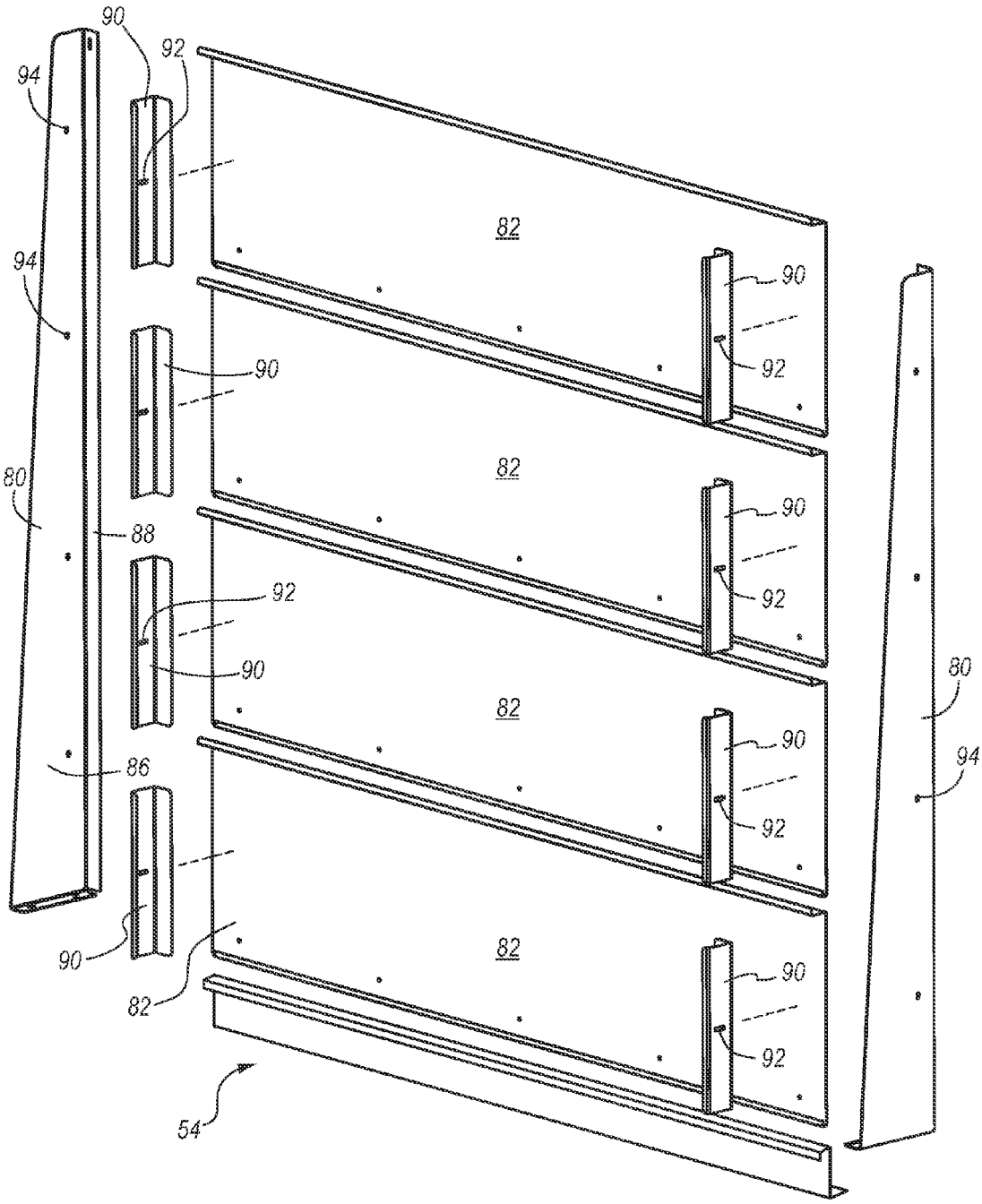
FIG. 6 is an exploded perspective view of one of the side walls of the wash fluid containment system of FIG. 1.

The vertical support members 80 may have any suitable shape or configuration. In one embodiment, the vertical support member 80 may be a gusset that extends downward to the base 52. The gusset may have a triangular shape that is oriented perpendicular to the plurality of panels 82 (FIG. 6). The triangular shape provides substantial rigidity to the side walls 54, 56, 58 without impairing the ability of the side walls 54, 56, 58 to adjust to terrain irregularities. The triangular shape also allows the side walls 54, 56, 58 to have straight self standing sections without relying on other walls coupled at right angles to provide support. In other words, each straight section of the side walls 54, 56, 58 can stand alone and does not have to be coupled to a perpendicular side wall to have sufficient support.

Figure 11:
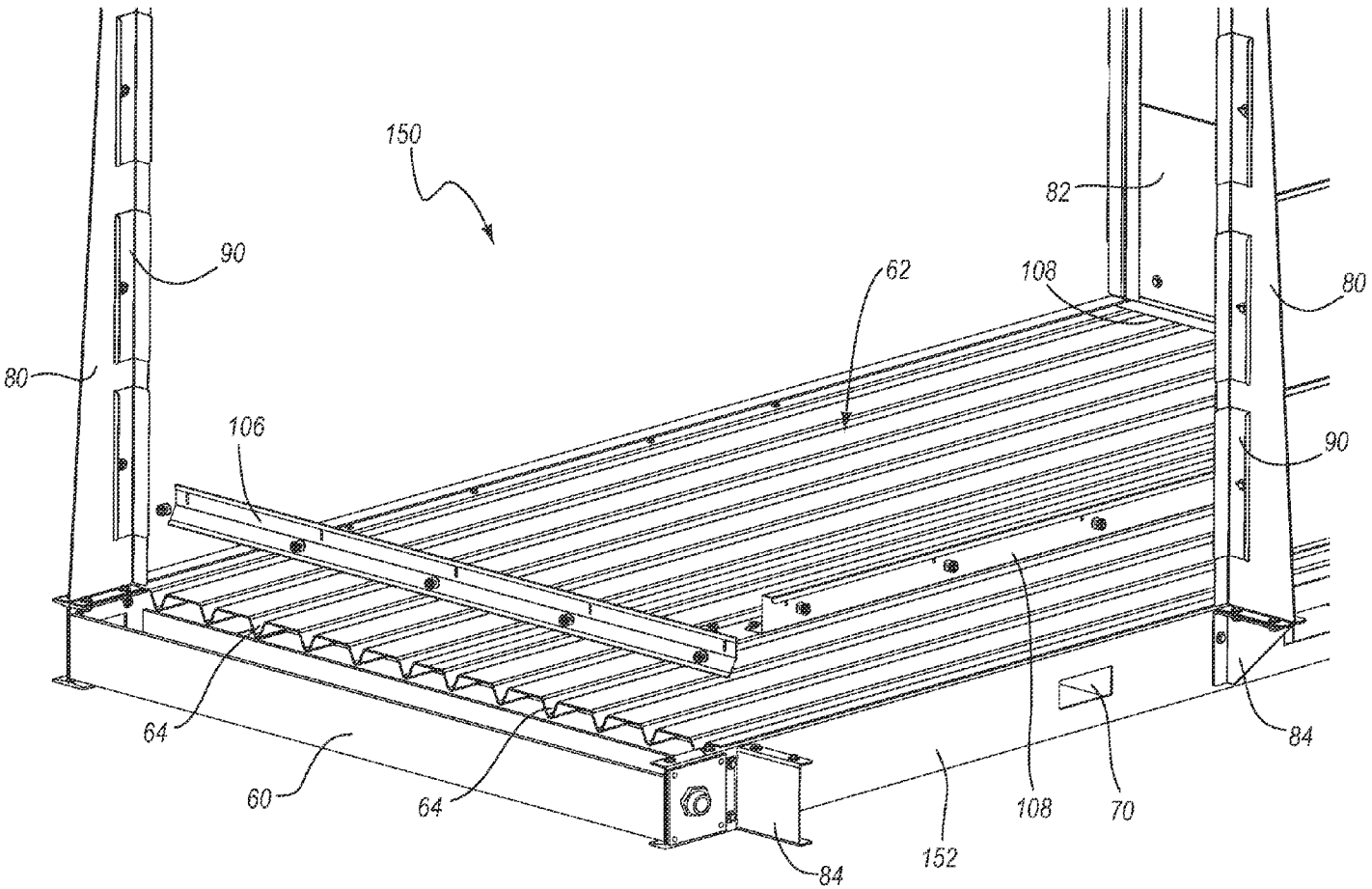
FIG. 11 is a perspective view of another embodiment of a wash fluid containment system that illustrates different deflectors that may be used to prevent wash fluid from leaking out and to direct the wash fluid into the collection trough.

It should be appreciated that the vertical support members 80 may have other suitable shapes and/or configurations. For example, the vertical support members 80 may have a rectangular shape instead of the triangular shape shown in the FIGS. The vertical support member 80 may be modified in any of a number of ways so long as it is capable of providing support to the side wall. In one embodiment, the vertical support member 80 is a gusset that supports and holds the panels 82 in place. In another embodiment, the design of the bracket 84 may be modified to have a different shape or configuration. For example, FIG. 11 shows one embodiment of an alternative bracket 84 that has a triangular shape.

Turning to FIG. 6, an exploded perspective view is shown of part of the side wall 54. The side wall 54 is used as an example to show how the side walls 54, 56, 58 are constructed. Thus, it should be appreciated that the concepts described in connection with FIG. 6 apply equally to the other side walls 56, 58.

Figure 8:
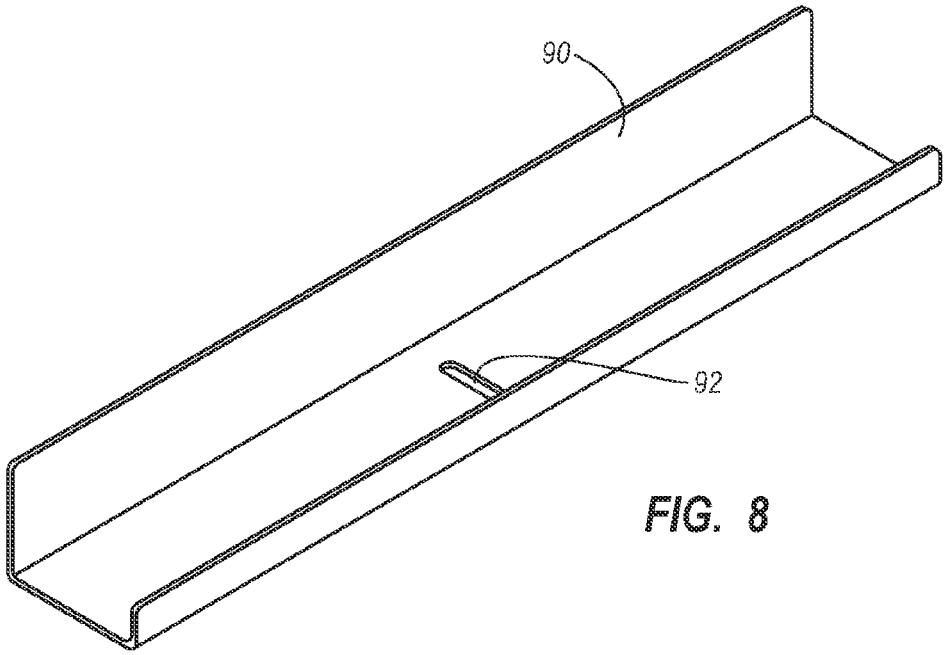
FIG. 8 is a perspective view of one embodiment of a bracket that is used to couple a panel to the vertical support member to form at least part of one of the side walls of the wash fluid containment system of FIG. 1.

Each one of the vertical support members 80 includes a body 86 and a flange or edge 88 that extends outward and away from the body 86 at a ninety degree angle. The flange 88 extends parallel to the panels 82. A plurality of brackets 90 are used to couple the panels 82 to the vertical support members 80. Each bracket 90 is coupled to the vertical support member 80 with a bolt that extends through a slot 92 in the bracket and a corresponding hole 94 in the vertical support member 80. A perspective view of the bracket 90 is shown in FIG. 8.

Figure 7:
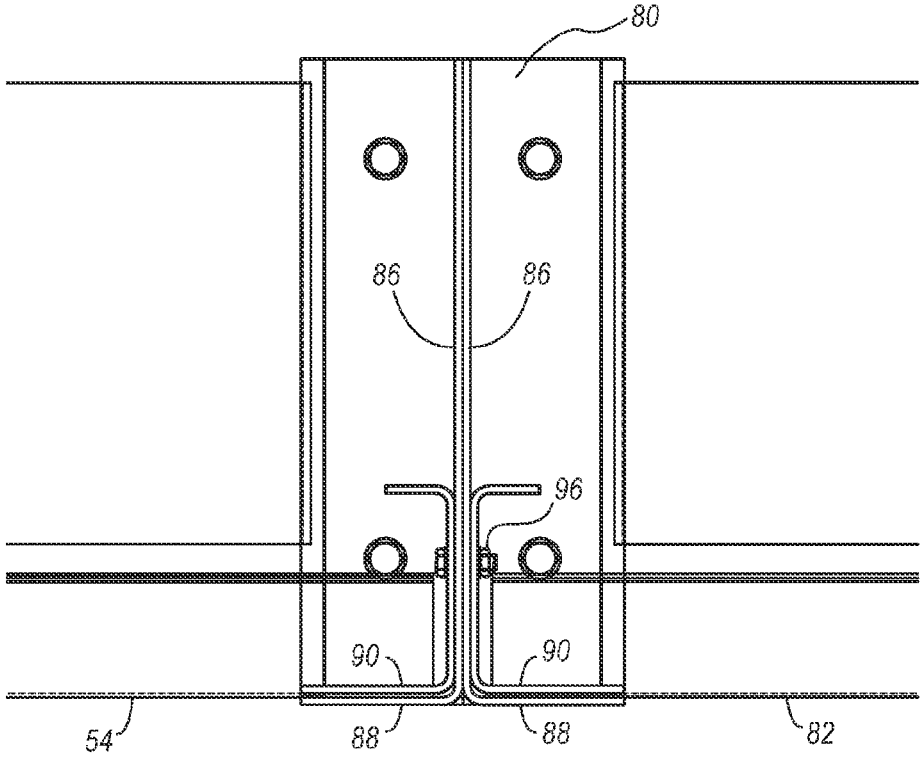
FIG. 7 is a top view of one of the side walls of the wash fluid containment system of FIG. 1.

The panels 82 are compressed or sandwiched between the flange 88 and the bracket 90 thereby holding the panels 82 in place. Turning to FIG. 7, a plan view is shown of the side wall 54 with the panels 82 coupled to the vertical support member 80. FIG. 7 shows the edges of the panels 82 positioned between the flange 88 of the vertical support member 80 and the bracket 90. The position of the panels 82 may be adjusted by loosening the bolt 96 and moving the bracket 90 toward or away from the panel 82. When the vertical support member 80 is positioned in the middle of the side wall 54, the bolt 96 may be used to hold the brackets 90 on opposite sides of the vertical support member 80 in place. Thus, loosening the bolt 96 allows either one or both of the brackets 90 to be adjusted.

The panels 82 are sized to allow enough room for the panels 82 to pivot relative to and/or move lengthwise outward from the vertical support members 80. When the wash fluid containment system 50 is deployed and the base 52 is uneven, the play between the panels 82 and the vertical support members 80 accommodates for the unevenness. It should be noted that the flange 88 that extends upward in a vertical direction is not coupled to the flange that extends outward in a horizontal direction at the bottom of the vertical support member 80 (the flange with holes in it). These two flanges are not coupled to allow the vertical support member 80 to move side to side to a small degree to further accommodate for the unevenness of the base 52. Thus, the vertical support members 80 can move so that they are not perpendicular to the base 52 as explained in greater detail below.

Figure 9:
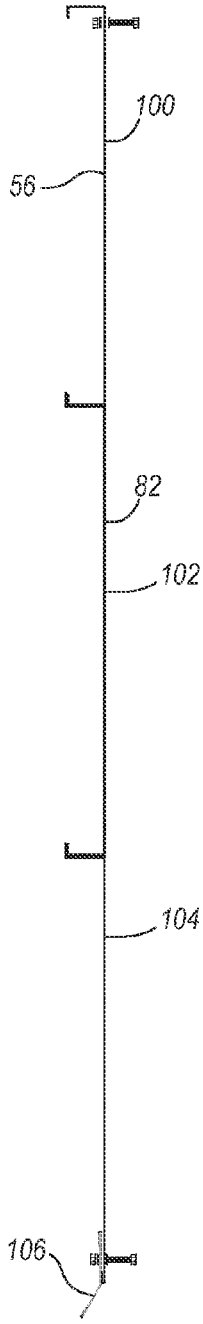
FIG. 9 is a side view of a cross section of a side wall of the wash fluid containment system of FIG. 1 that is adjacent to the collection trough.
Figure 10:
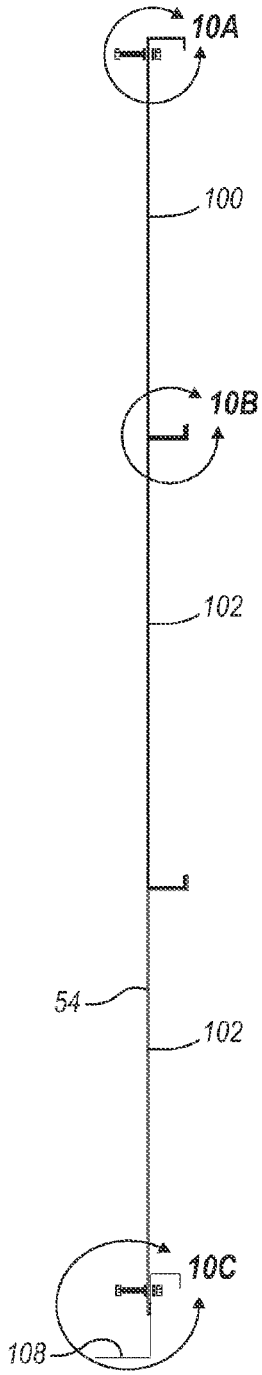
FIG. 10 is a side view of a cross section of a side wall of the wash fluid containment system of FIG. 1 that is not adjacent to the collection trough.
Figure 10A:
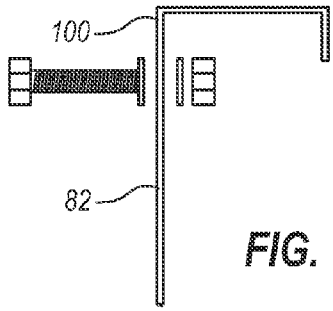
FIG. 10A is a blown up view of the top of the top panel of the side wall of FIG. 10.

Turning to FIGS. 9, 10, and 10A-10C, various profile views of one embodiment of the panels 82 are shown. In this embodiment, the panels 82 include a top panel 100, a middle panel 102, and a bottom panel 104. The top panel 100 has a top edge that extends horizontally outward and away from the top panel 100 for a short distance and then turns downward (FIG. 10A). This configuration may be desirable to keep the potentially sharp edge at the top of the top panel 100 from cutting the user.

Figure 10B:
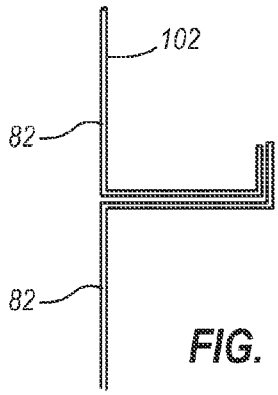
FIG. 10B is a blown up view showing where two panels of the side wall of FIG. 10 meet.

The top panel 100 has a bottom edge that extends horizontally outward and away from the top panel 100 for a short distance and then turns upward. The middle panel 102 has a top edge that is complimentary in shape to the bottom edge of the top panel 100 so that the top edge of the middle panel 102 can receive the bottom edge of the top panel 100. The upward turn in both edges makes it extremely difficult, if not impossible, for wash fluid to pass through the side walls 54, 56, 58 at the joint where the two panels 100, 102 meet (FIG. 10B). The bottom edge of the middle panel 102 and the top edge of the bottom panel 104 are configured in a similar fashion.

Figure 10C:
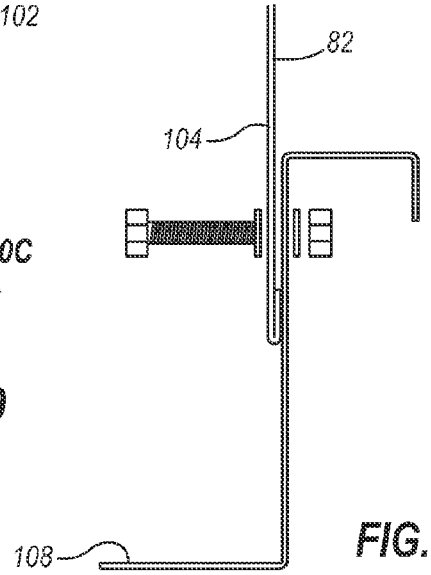
FIG. 10C is a blown up view of the bottom of the bottom panel of the side wall of FIG. 10.
Figure 12:
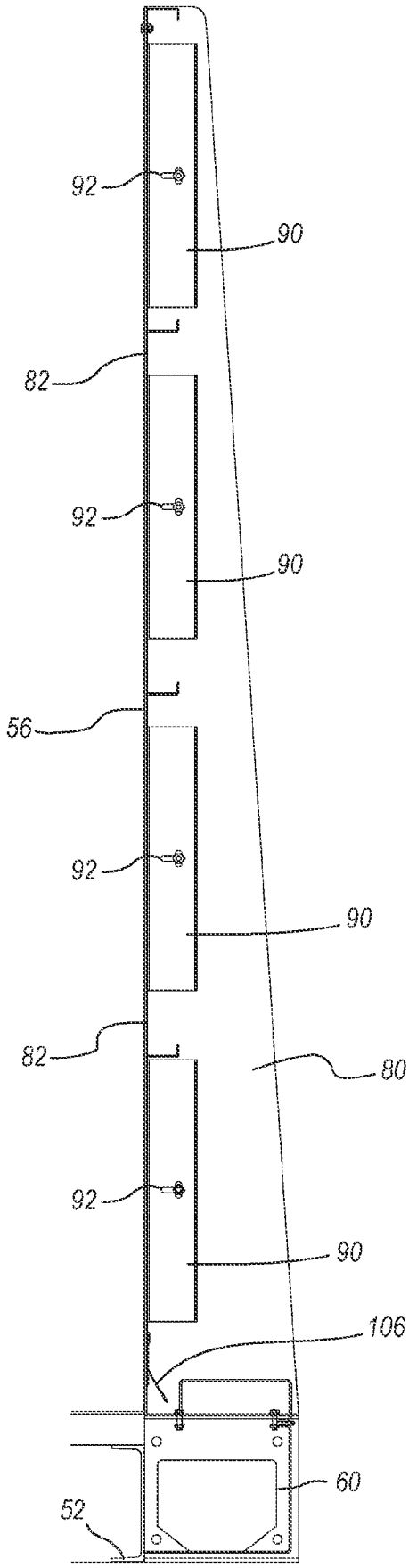
FIG. 12 is a side view of a cross section of one of the side walls of the wash fluid containment system of FIG. 1.

The bottom panel 104 includes a bottom edge that extends straight down without a horizontally extending portion, although the edge may be bent back on itself as shown in FIG. 10C. The bottom edge of the bottom panel 104 is configured to be coupled to a deflector 106, 108. The deflector 106 is provided on the side wall 56 that is adjacent to the collection trough 60. The deflector 106 is designed to allow the wash fluid to flow under the side wall 56 and into the collection trough 60. As illustrated in FIG. 9, the deflector 106 is angled backward to allow for an open space at the bottom of the side wall 56 for the wash fluid to flow through (FIG. 12).

The deflector 108 is designed to prevent wash fluid from escaping underneath the side walls 54, 58. As illustrated in FIG. 10, the deflector 108 has an L shape where the bottom of the L extends outward a short distance over the top surface 62 of the base 52. Any wash fluid that runs down the side walls 54, 58 will be directed back onto the top surface 62 of the base 52 by the deflector 108.

FIG. 11 shows another embodiment of a wash fluid containment system 150. This embodiment is similar in many ways to the wash fluid containment system 50. In particular, many of the components are the same or similar. The wash fluid containment system 150 illustrates how the deflectors 106, 108 are positioned relative to the base 152.

Figure 13:
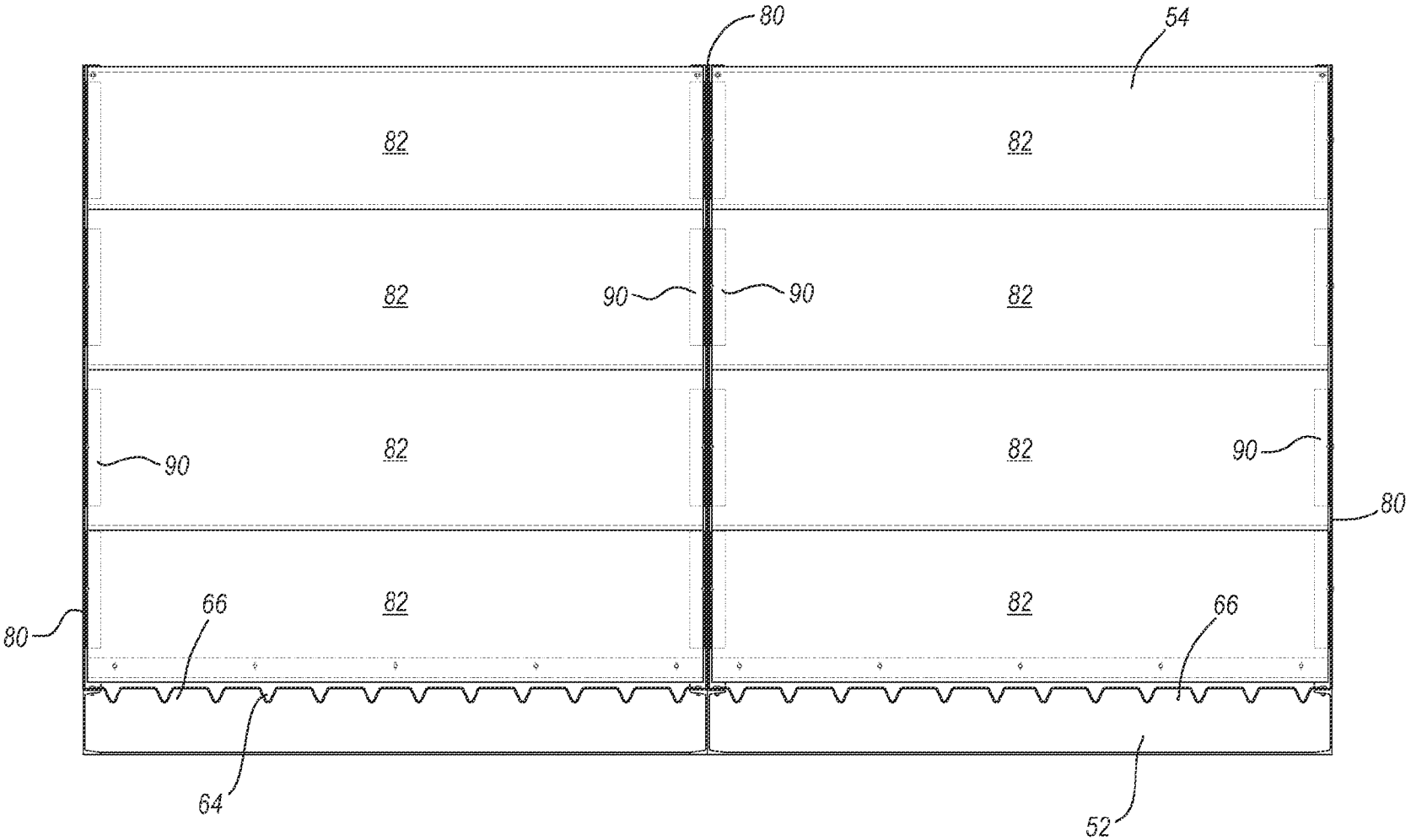
FIG. 13 is a side view of the wash fluid containment system of FIG. 1 positioned on a flat surface.
Figure 14:
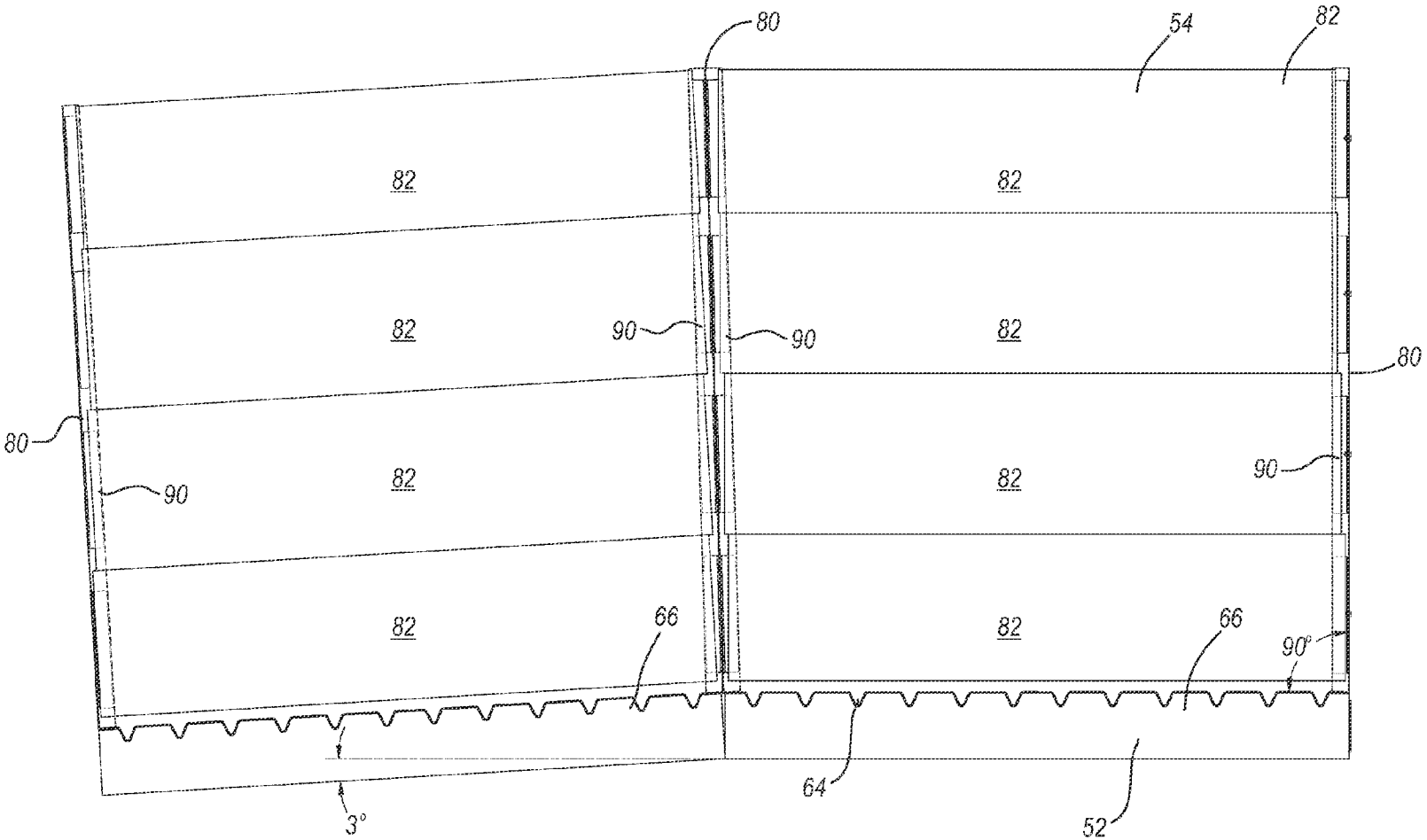
FIGS. 14 and 15 are side views of the wash fluid containment system of FIG. 1 positioned on an uneven surface.
Figure 15:
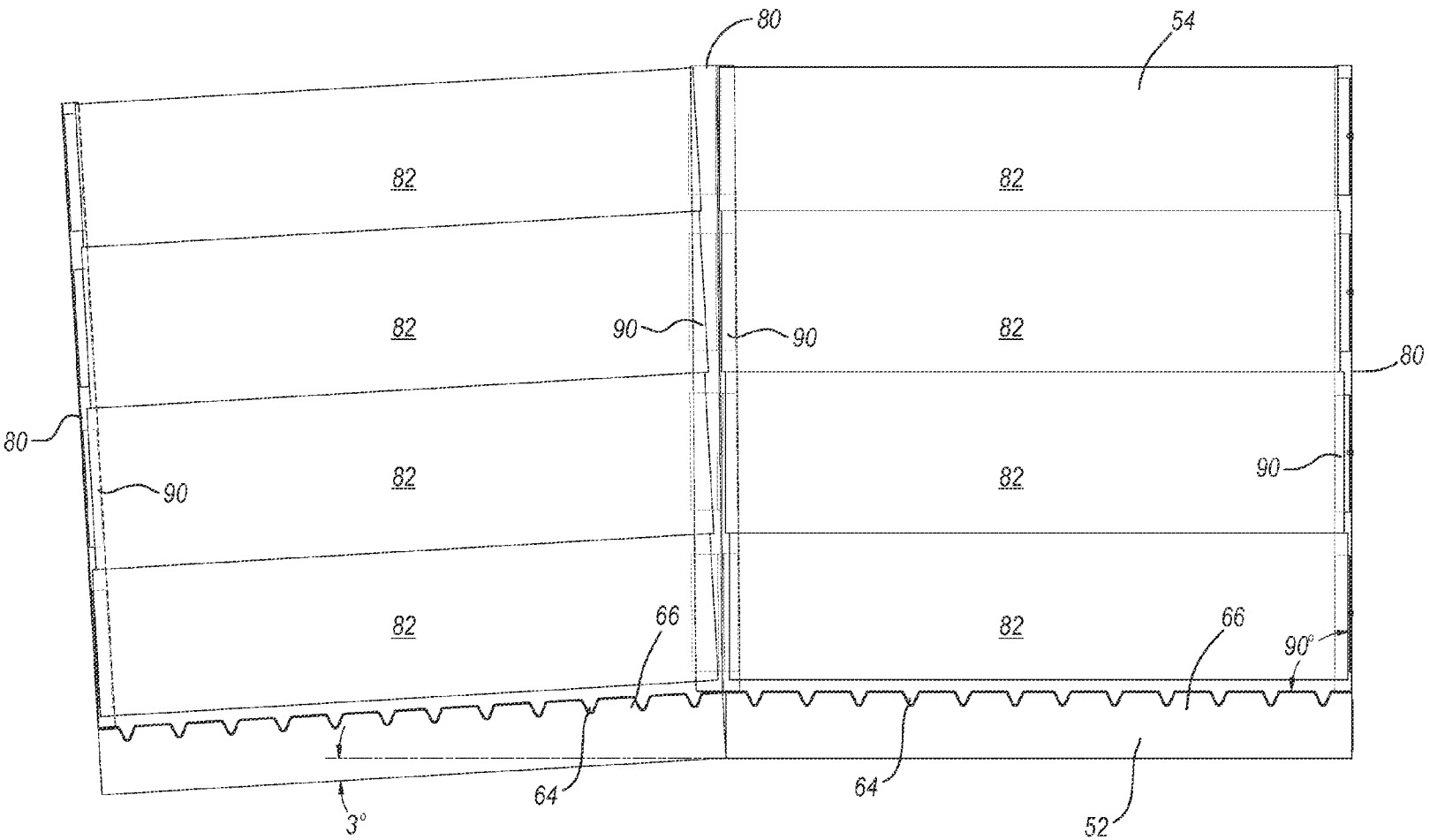

FIGS. 13 to 15 illustrate how the side wall 54 is capable of accommodating for unevenness in the base 52 of the wash fluid containment system 50. FIG. 13 shows the wash fluid containment system 50 with the base 52 being even and flat. FIGS. 14 and 15 show the base 52 positioned on uneven ground so that the left base module 66 has pivoted down approximately three degrees.

In the embodiment shown in FIG. 14, the vertical support member 80 on the right side of the side wall 54 is perpendicular to the base module 66 that is coupled to. Thus, the rightmost vertical support member 80 extends straight upward from the base 54. The center vertical support member 80, on the other hand, is not perpendicular to either one of the base modules 66. Instead, the center vertical support member 80 splits the three degree difference between the base modules 66 so that the center vertical support member 80 is one and a half degrees from being perpendicular to each one of the base modules 66. The leftmost vertical support member 80 is perpendicular to the left base module 66.

The unevenness of the base 52 makes it so that the distance between the top of the vertical support members 80 is greater than the distance between the bottom of the vertical support members 80. However, the panels 82 sufficiently overlap the brackets 90 and the flanges 88 at the top of vertical support members 80 to accommodate for the extra distance without creating a gap. In this embodiment, the top and bottom edges of the panels 82 are parallel to each other. The rightmost and leftmost vertical support members 80 are perpendicular to the panels 82 attached to them. However, the center vertical support member 80 is not perpendicular to any of the panels 82 attached to it.

The embodiment shown in FIG. 15 is similar to that shown in FIG. 14 except that in this embodiment, all of the vertical support members 80 extend straight upward. Since the right base module 66 is flat, the rightmost and center vertical support members 80 extend upward at right angles to the right base module 66. The panels 82 extend horizontally between the rightmost and center vertical support members 80 and are perpendicular to the rightmost and center vertical support members 80.

The leftmost vertical support member 80 is not oriented at a right angle relative to the left base module 66 because the left base module 66 is sloped downward three degrees relative to the right base module 66. Once again, the overlap of the panels 82 with the brackets 90 and the flanges 88 from the leftmost and center vertical support members 80 allows the panels 82 to slope downward like the left base module 66 without creating a gap in the side wall 54.

It should be appreciated that the side walls 54, 56, 58 can also accommodate for situations where one of the two base modules shown in FIG. 13 slopes upward. In this situation, the panels 82 would extend further behind the brackets 90 and flanges 88 on each side to account for the unevenness of the base 52. Also, in this situation, the center vertical support member 80 may split the difference between the base modules 66, or both the center vertical support member 80 and one of the left or right vertical support members 80 may be positioned perpendicular to the underlying base module 66 while the other remaining vertical support member 80 is not perpendicular to the underlying base module 66.

Overlapping the panels 82 with the brackets 90 and the flanges 88 of the vertical support members 80 gives the side walls 54, 56, 58 the ability to expand and contract widthwise to accommodate for the unevenness of the base 52. The adjustable connection between the brackets 90 and the vertical support members 80 allow the user to easily adjust the side wall 54, 56, 58 after initial setup. Thus, the side walls 54, 56, 58 may be adjustable between a first configuration where at least one of the vertical support members 80 and the panels 82 are movable relative to the other one and a second configuration where the vertical support members 80 and the panels 82 are fixed together in an impermanent manner.

The side walls 54, 56, 58 may also be capable of accommodating for movement of the base modules 66 when a vehicle or other large object is moved onto the base 52. It is not uncommon for the base modules 66 to move as heavy equipment and the like is moved over the base modules 66. The base modules 66 can pivot along the axis defined by the joint between each base module 66 or the base modules 66 can pivot on an axis that is perpendicular to the joint. In the former situation, the side walls tend to toward or away from each other as shown in FIGS. 14 and 15 (i.e., the side walls bind or create gaps). The side walls pivot along an axis that is perpendicular to the plane of the side walls. In the latter situation, the side walls tend to pivot inward or outward from the interior of the system 50 along an axis that is parallel to the plane of the side wall.

The side walls 54, 56, 58 may be configured to accommodate for any of these movements. For example, the friction fit of the panels 82 between the brackets 90 and the flange 88 of the vertical support members 80 allows the panels 82 to move as the base modules 66 move. Also, the thin flat shape of the panels 82 allow them to also twist as the side walls move inward or outward from the interior of the system 50. It should be appreciated that the panels 82 may be narrower (from top to bottom) to allow greater flexibility if desired.

Illustrative Embodiments

Reference is made in the following to a number of illustrative embodiments of the subject matter described herein. The following embodiments illustrate only a few selected embodiments that may include the various features, characteristics, and advantages of the subject matter as presently described. Accordingly, the following embodiments should not be considered as being comprehensive of all of the possible embodiments. Also, features and characteristics of one embodiment may and should be interpreted to equally apply to other embodiments or be used in combination with any number of other features from the various embodiments to provide further additional embodiments, which may describe subject matter having a scope that varies (e.g., broader, etc.) from the particular embodiments explained below. Accordingly, any combination of any of the subject matter described herein is contemplated.

According to one embodiment, a wash fluid containment system comprises: a base; and a side wall that extends upward from the base. The side wall may include a first vertical support member, a second vertical support member, a top, and a bottom. The top and the bottom of the side wall may be parallel to each other and at least one of the first vertical support member or the second vertical support member may not be perpendicular to at least one of the top or the bottom of the side wall. The first vertical support member and the second vertical support member may be positioned parallel to each other. The first vertical support member and the second vertical support member may not be positioned parallel to each other. The wash fluid containment system may comprise a panel that extends between the first vertical support member and the second vertical support member. The panel may be adjustable relative to at least one of the first vertical support member or the second vertical support member. The base may rest on a ground surface in an impermanent manner. The base may include a top surface having a plurality of channels that drain wash fluid.

According to another embodiment, the wash fluid containment system comprises: a base; and a side wall that extends upward from the base. The side wall may include a first portion and a second portion. The first portion of the side wall may be adjustable relative to the second portion of the side wall to accommodate for unevenness in the base. At least one corner of the side wall may not be square. The first portion of the side wall may include a vertical support member that extends upward from the base and the second portion of the side wall may include a panel that extends horizontally outward from the vertical support member. The side wall may include a plurality of panels that extend horizontally outward from the vertical support member. The plurality of panels may be configured to prevent wash fluid from escaping through the side wall between the plurality of panels. The side wall may be adjustable between a first configuration where the first portion of the side wall is movable relative to the second portion of the side wall and a second configuration where the first portion of the side wall and the second portion of the side wall are fixed together in a impermanent manner.

According to another embodiment, a wash fluid containment system comprises: a base which is uneven; and a side wall that extends upward from the base. The side wall and the base may be configured to prevent wash fluid from escaping from the wash fluid containment system. The side wall may be adjustable relative to the base to accommodate for the unevenness of the base. The side wall may include a panel that is movable relative to the base to accommodate for the unevenness of the base. The base may rest on a ground surface in an impermanent manner. The side wall may be adjustable between a first configuration where the side wall is movable relative to the base and a second configuration where the side wall and the base are fixed together in a impermanent manner.

According to another embodiment, a wash fluid containment system comprises: a base including a first base module coupled to a second base module; and a side wall coupled to the base, the side wall including a plurality of vertical support members and a plurality of panels that extend between the plurality of vertical support members. The plurality of panels may be adjustable relative to at least one vertical support member from the plurality of vertical support members to accommodate for unevenness between the first base module of the base and the second base module of the base. The plurality of vertical support members may include a first vertical support member and a second vertical support member. The plurality of panels may extend between the first vertical support member and the second vertical support member. The plurality of panels may also be adjustable relative to the first vertical support member and the second vertical support member. The at least one vertical support member may extend at least substantially straight upward. The side wall may include a bracket. The bracket may be adjustable between a first configuration where at least one panel from the plurality of panels is compressed between the bracket and the at least one vertical support member in a fixed position and a second configuration where the at least one panel is movable relative to the at least one vertical support member. One of the plurality of panels or the at least one vertical support member may overlap the other one of the plurality of panels or the at least one vertical support member.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as "have," "having," "include," and "including" should be construed to be synonymous with the terms "comprise" and "comprising."

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A wash fluid containment system comprising:

a base; and a side wall that is secured to and extends upward from the base, the side wall including a first vertical support member, a second vertical support member, a top, a bottom, a plurality of planar panels, and a plurality of panel mounting brackets, the planar panels being mounted to the first and second vertical support members with the panel mounting brackets, the first and second vertical support members being adjustable relative to each other;

wherein the top and the bottom of the side wall are parallel to each other and at least one of the first vertical support member and the second vertical support member is adjustable after assembly of the side wall between a first position perpendicular to at least one of the top and bottom of the side wall, and a second position not perpendicular to at least one of the top or the bottom of the side wall.

2. The wash fluid containment system of claim 1 wherein the first vertical support member and the second vertical support member are positioned parallel to each other.

3. The wash fluid containment system of claim 1 wherein the first vertical support member and the second vertical support member are not positioned parallel to each other.

4. The wash fluid containment system of claim 1 wherein the plurality of panels are adjustable relative to at least one of the first vertical support member or the second vertical support member.

5. The wash fluid containment system of claim 1 wherein the base rests on a ground surface in an impermanent manner.

6. The wash fluid containment system of claim 1 wherein the base includes a top surface having a plurality of channels that drain wash fluid.

7. The wash fluid containment system of claim 1 wherein the panels are compressed between the panel mounting brackets and a flange portion of the first and second vertical support members, and the panel mounting brackets are mounted to the first and second vertical support members.

8. A wash fluid containment system comprising:

a base; and a side wall that extends upward from the base, the side wall including a first portion and a second portion, the first portion including first and second vertical support members, the second portion including a plurality of planar panels, a bottom end of the first and second vertical support members being fixed to the base, and a top end of the first and second vertical support members being adjustable relative to the base after assembly of the side wall to accommodate for unevenness in the base.

9. The wash fluid containment system of claim 8 wherein at least one corner of the side wall is not square.

10. The wash fluid containment system of claim 8 wherein the panels extend horizontally outward from the first and second vertical support member members.

11. The wash fluid containment system of claim 10 wherein the plurality of panels are configured to prevent wash fluid from escaping through the side wall between the plurality of panels.

12. The wash fluid containment system of claim 8 wherein the side wall is adjustable between a first configuration wherein at least one of the first portion of the side wall or the second portion of the side wall is movable relative to the other one of the first portion of the side wall or the second portion of the side wall, and a second configuration wherein the first portion of the side wall and the second portion of the side wall are fixed together in an impermanent manner.

13. A wash fluid containment system comprising:

a base which is uneven; and a side wall that is mounted to and extends upward from the base, the side wall having a continuous construction that includes a plurality of vertical posts fixed at a bottom end to the base, and a plurality of panels mounted to the plurality of vertical posts, the side wall and the base being configured to prevent wash fluid from escaping from the wash fluid containment system;

wherein at least one of the plurality of posts or the plurality of panels is adjustable relative to the base after assembly of the side wall to accommodate for the unevenness of the base and without creating openings in the continuous construction of the side wall.

14. The wash fluid containment system of claim 13 wherein the side wall includes a plurality of panels that are movable relative to the base to accommodate for the unevenness of the base.

15. The wash fluid containment system of claim 13 wherein the base rests on a ground surface in an impermanent manner.

16. The wash fluid containment system of claim 13 wherein the side wall is adjustable between a first configuration where the side wall is movable relative to the base and a second configuration where the side wall and the base are fixed together in an impermanent manner.

17. A wash fluid containment system comprising:

a base including a first base module coupled to a second base module; and a side wall coupled to the base, the side wall including a plurality of vertical support members and a plurality of panels that extend between the plurality of vertical support members, a bottom end of the plurality of vertical support members being fixed to the base;

wherein the plurality of panels are adjustable relative to at least one vertical support member and at least one of the vertical support members is adjustable relative to the base to accommodate for unevenness between the first base module of the base and the second base module of the base after assembly of the side wall.

18. The wash fluid containment system of claim 17 wherein the plurality of vertical support members includes a first vertical support member and a second vertical support member, and wherein the plurality of panels extend between the first vertical support member and the second vertical support member, the plurality of panels being adjustable relative to the first vertical support member and the second vertical support member.

19. The wash fluid containment system of claim 17 wherein the at least one vertical support member extends at least substantially straight upward.

20. The wash fluid containment system of claim 17 wherein the side wall includes a bracket and wherein the bracket is mounted to the at least one vertical support member and adjustable between a first configuration where at least one panel from the plurality of panels is compressed between the bracket and the at least one vertical support member in a fixed position and a second configuration where the at least one panel is movable relative to the at least one vertical support member.

21. The wash fluid containment system of claim 17 wherein one of the plurality of panels or the at least one vertical support member overlaps the other one of the plurality of panels or the at least one vertical support member.

22. A wash fluid containment system comprising:

a base; and a side wall that is secured to and extends upward from the base, the side wall including a first vertical support member, a second vertical support member, a plurality of planar panels, and a plurality of panel mounting brackets, the planar panels being compressed between the first and second vertical support members and the plurality of panel mounting brackets;

wherein the plurality of planar panels are movable relative to the first and second vertical support members and the plurality of panel mounting brackets after assembly of the side wall.

23. The wash fluid containment system of claim 22 wherein the plurality of panels are movable upon movement of at least one of the first vertical support member and the second vertical support member between a first position perpendicular to the plurality of planar panels and a second position not perpendicular to the plurality of planar panels.

24. The wash fluid containment system of claim 22 wherein the first vertical support member and the second vertical support member are positioned parallel to each other in the first and second positions.

25. The wash fluid containment system of claim 22 wherein the first vertical support member and the second vertical support member are not positioned parallel to each other in the second position.

26. The wash fluid containment system of claim 22 wherein the plurality of panel mounting brackets maintain a fixed position relative to the first and second vertical support members after assembly of the side wall.

27. The wash fluid containment system of claim 22 wherein the planar panels are mounted to the first and second vertical support members solely with a compression force applied between the first and second vertical support members and the plurality of panel mounting brackets.

* * * * *